US009133656B2

(12) United States Patent
Steen et al.

(10) Patent No.: US 9,133,656 B2
(45) Date of Patent: Sep. 15, 2015

(54) INVERTED CONSTANT FORCE WINDOW BALANCE FOR TILT SASH

(75) Inventors: Travis Steen, Sioux Falls, SD (US); Chad Swier, Sioux Falls, SD (US); Dan Raap, Hartford, SD (US); Gary R. Newman, Valley Springs, SD (US); Bruce Hagemeyer, Pella, IA (US)

(73) Assignee: AMESBURY GROUP, INC., Amesbury, MA (US)

( * ) Notice: Subject to any disclaimer, the term of this patent is extended or adjusted under 35 U.S.C. 154(b) by 139 days.

(21) Appl. No.: 13/081,089

(22) Filed: Apr. 6, 2011

(65) Prior Publication Data

US 2011/0239402 A1 Oct. 6, 2011

Related U.S. Application Data

(60) Provisional application No. 61/321,340, filed on Apr. 6, 2010.

(51) Int. Cl.
*E05D 13/00* (2006.01)

(52) U.S. Cl.
CPC ..... *E05D 13/1276* (2013.01); *E05Y 2900/148* (2013.01); *Y10T 16/6298* (2015.01); *Y10T 16/64* (2015.01)

(58) Field of Classification Search
CPC . E05D 13/1276; E05D 13/1253; E05D 13/12; E05D 13/00; Y10T 16/64
USPC ..... 16/193, 197; 49/445, 447
See application file for complete search history.

(56) References Cited

U.S. PATENT DOCUMENTS

| | | | | |
|---|---|---|---|---|
| 698,168 | A | | 4/1902 | Barnum |
| 2,609,191 | A | | 9/1952 | Foster |
| 2,609,193 | A | | 9/1952 | Foster |
| 2,622,267 | A | | 12/1952 | Peremi |
| 2,851,721 | A | | 9/1958 | Decker et al. |
| 3,150,420 | A | * | 9/1964 | Brenner ..... 49/445 |
| 3,184,784 | A | | 5/1965 | Peters |
| 3,434,236 | A | | 3/1969 | Weidner et al. |
| 3,475,865 | A | | 11/1969 | Arnes |
| 3,529,381 | A | | 9/1970 | Grossman |
| 3,820,193 | A | | 6/1974 | Foster |
| 3,844,066 | A | | 10/1974 | Nobes |
| 3,869,754 | A | | 3/1975 | Foster |
| 3,992,751 | A | | 11/1976 | Foster et al. |
| 4,028,849 | A | | 6/1977 | Anderson |
| 4,079,549 | A | | 3/1978 | Wood |
| 4,190,930 | A | | 3/1980 | Prosser |
| 4,227,345 | A | | 10/1980 | Durham, Jr. |
| 4,446,654 | A | | 5/1984 | Schoolman et al. |

(Continued)

FOREIGN PATENT DOCUMENTS

| | | | |
|---|---|---|---|
| CA | 1155341 | A1 | 10/1983 |
| GB | 1505782 | A | 3/1978 |
| JP | 03197785 | A | 8/1991 |

*Primary Examiner* — Emily Morgan
(74) *Attorney, Agent, or Firm* — Goodwin Procter LLP

(57) ABSTRACT

A window balance may include a shoe body with an elongate portion and an enlarged portion. The elongate portion may include at least one carrier section for supporting a coil spring and an enlarged portion may include a locking element and a cam in communication with the locking element. The width of the enlarged portion may be greater than the width of the elongate portion. The spring may rest in the carrier section and may be secured to a window jamb with a fastener or a mounting element.

14 Claims, 12 Drawing Sheets

(56) References Cited

U.S. PATENT DOCUMENTS

| | | | | | |
|---|---|---|---|---|---|
| 4,452,012 | A | | 6/1984 | Deal | |
| 4,517,766 | A | | 5/1985 | Haltof | |
| 4,555,868 | A | | 12/1985 | Mancuso | |
| 4,571,887 | A | | 2/1986 | Haltof | |
| 4,590,708 | A | | 5/1986 | Campodonico | |
| 4,610,108 | A | | 9/1986 | Marshik | |
| 4,683,676 | A | | 8/1987 | Sterner, Jr. | |
| 4,689,850 | A | | 9/1987 | Flight | |
| 4,718,194 | A | | 1/1988 | FitzGibbon et al. | |
| 4,799,333 | A | | 1/1989 | Westfall et al. | |
| 4,837,976 | A | | 6/1989 | Westfall et al. | |
| 4,854,077 | A | | 8/1989 | Rogers et al. | |
| 4,885,871 | A | | 12/1989 | Westfall et al. | |
| 4,888,915 | A | | 12/1989 | Goldenberg | |
| 4,914,861 | A | | 4/1990 | May | |
| 4,935,987 | A | | 6/1990 | Sterner, Jr. | |
| 4,941,285 | A | | 7/1990 | Westfall | |
| 4,953,258 | A | * | 9/1990 | Mennuto | 16/197 |
| 4,961,247 | A | * | 10/1990 | Leitzel et al. | 16/197 |
| 5,035,081 | A | | 7/1991 | Yamamoto et al. | |
| 5,113,922 | A | | 5/1992 | Christensen et al. | |
| 5,119,591 | A | | 6/1992 | Sterner, Jr. et al. | |
| 5,119,592 | A | | 6/1992 | Westfall et al. | |
| 5,157,808 | A | | 10/1992 | Sterner, Jr. | |
| 5,210,976 | A | * | 5/1993 | Cripps | 49/181 |
| 5,232,208 | A | * | 8/1993 | Braid et al. | 267/156 |
| 5,353,548 | A | | 10/1994 | Westfall | |
| 5,365,638 | A | | 11/1994 | Braid et al. | |
| 5,383,303 | A | | 1/1995 | Nakanishi et al. | |
| 5,463,793 | A | * | 11/1995 | Westfall | 16/197 |
| 5,544,450 | A | | 8/1996 | Schmidt et al. | |
| 5,661,927 | A | * | 9/1997 | Polowinczak et al. | 49/447 |
| D467,490 | S | | 12/2002 | Uken et al. | |
| 6,553,620 | B2 | * | 4/2003 | Guillemet et al. | 16/197 |
| 6,622,342 | B1 | * | 9/2003 | Annes et al. | 16/197 |
| 6,679,000 | B2 | | 1/2004 | Uken et al. | |
| 6,820,368 | B2 | | 11/2004 | Uken et al. | |
| 6,857,228 | B2 | | 2/2005 | Kunz et al. | |
| 6,860,066 | B2 | | 3/2005 | Kunz et al. | |
| 6,931,788 | B2 | | 8/2005 | Uken et al. | |
| 6,990,710 | B2 | | 1/2006 | Kunz et al. | |
| 7,191,562 | B2 | | 3/2007 | Uken et al. | |
| 7,552,510 | B2 | * | 6/2009 | Harold et al. | 16/197 |
| 7,587,787 | B2 | * | 9/2009 | Pettit | 16/197 |
| 7,735,191 | B2 | * | 6/2010 | Tuller | 16/193 |
| 7,966,770 | B1 | | 6/2011 | Kunz | |
| 8,132,290 | B2 | * | 3/2012 | Liang et al. | 16/193 |
| 2003/0192147 | A1 | * | 10/2003 | Braid et al. | 16/197 |
| 2003/0213096 | A1 | * | 11/2003 | Annes et al. | 16/216 |
| 2004/0237256 | A1 | * | 12/2004 | Lutfallah | 16/197 |
| 2005/0229492 | A1 | * | 10/2005 | Robertson | 49/181 |
| 2007/0101654 | A1 | * | 5/2007 | Robertson | 49/445 |
| 2008/0178425 | A1 | * | 7/2008 | Tuller | 16/197 |
| 2009/0188075 | A1 | * | 7/2009 | Baker | 16/196 |

* cited by examiner

INVERTED CONSTANT FORCE WINDOW BALANCE FOR TILT SASH

PRIORITY CLAIM

This application claims priority to and the benefit of U.S. Provisional Patent Application Ser. No. 61/321,340, filed on Apr. 6, 2010, the disclosure of which is hereby incorporated herein by reference in its entirety.

FIELD OF THE INVENTION

This application relates to window sash balances and, more particularly, to inverted constant force window balance systems for tilt sashes.

BACKGROUND OF THE INVENTION

Inverted constant force window balance systems are depicted in, for example, U.S. Pat. Nos. 5,353,548 and 5,463,793, the disclosures of which are hereby incorporated by reference herein in their entireties. Inverted constant force window balances utilize a housing or shoe that carries a coil spring having a free end secured to a window jamb channel with a mounting bracket, screw, or other element. As the coil spring unwinds, the recoil tendency of the spring produces an upward force to counter the weight of the window sash. The shoe may be a tilt-in shoe that allows the window sash to tilt inwards for cleaning and/or installation/removal purposes. As the window sash tilts, a locking mechanism holds the shoe in place to prevent the coil spring from retracting the shoe in the absence of the weight of the sash.

Existing tilt-in inverted constant force window balances, however, suffer from several shortcomings. First, as with many types of balance shoes, the locking shoes used with inverted constant force window balances are dimensioned such that they can not easily be inserted into the window jamb channel. Second, particularly heavy window sashes may require more than a single spring on each side to provide an adequate counterbalance. While it is possible to add additional springs in regular constant force window balances (in which the coil springs are located in a fixed position at the top of the window jamb channel), adding additional springs to inverted constant force balances requires modifications of the shoes, or the addition of supplemental or companion spring carriers. Third, dust and debris from new construction or aging installations may enter the coil spring, thereby preventing proper operation thereof. What is needed then, is an inverted constant force balance that addresses these and other shortcomings.

SUMMARY OF THE INVENTION

In one aspect, the invention relates to a window balance having a shoe body including an elongate portion including at least one carrier section for supporting a coil spring, and an enlarged portion including a locking element and a cam in communication with the locking element, wherein the enlarged portion has a width greater than a width of the elongate portion.

In an embodiment of the above aspect, the window balance includes a coil spring supported in the at least one carrier section. In another embodiment, the coil spring includes a plurality of coil springs and the at least one carrier section includes a plurality of carrier sections. In still another embodiment, a first coil spring defines an opening and wherein a second coil spring defines a tab, wherein the opening is configured to receive the tab. In yet another embodiment, the window balance includes an element for securing the spring to a window jamb channel. In still another embodiment, the securing element is at least one of a spring clip, a mounting bracket, a hook, a screw, and combinations thereof. In another embodiment the securing element includes a mounting bracket having a receiver and wherein the shoe body has a projection adapted to mate with the receiver when the shoe body is proximate the mounting bracket.

In another embodiment of the above aspect, the window balance includes an element for wiping a coil spring, the element projecting beyond a side wall of the elongate portion. In another embodiment, the wiping element includes at least one of a fabric pile, a foam projection, a plastic projection, a rubber projection, and combinations thereof. In yet another embodiment, the window balance includes a debris trap located above the at least one carrier section. In still another embodiment, the elongate member defines a groove for receiving a pivot bar of a window sash.

In an embodiment of the above aspect, the cam defines a keyhole opening for receiving the pivot bar. In another embodiment the groove is aligned with the keyhole opening of the cam. In yet another embodiment, the elongate portion includes two side walls defining an elongate portion width therebetween. In still another embodiment, the enlarged portion includes a first projection and a second projection, and wherein each of the first projection and the second projection include a side wall defining therebetween an enlarged portion width greater than the elongate portion width. In another embodiment, the shoe body is a unitary component.

In an embodiment of the above aspect, the shoe body includes a first component and a discrete second component. In another embodiment, the first component includes the enlarged portion and the second component includes the elongate portion, and wherein the enlarged portion is secured to the elongate portion with a connector. In yet another embodiment, the connector is a hanger.

In another embodiment, the invention relates to a method of supporting a tilt-in sash in a window. The method includes providing a shoe body having an elongate portion including at least one carrier section for supporting a coil spring and an enlarged portion including a locking element and a cam in communication with the locking element, wherein the enlarged portion has a width greater than a width of the elongate portion. The method also includes providing a sash comprising a pivot bar, inserting the pivot bar into the cam, and rotating the sash to align with the window.

BRIEF DESCRIPTION OF THE DRAWINGS

There are shown in the drawings embodiments that are presently preferred, it being understood, however, that the invention is not limited to the precise arrangements and configurations shown.

DETAILED DESCRIPTION OF THE INVENTION

Figure 1:
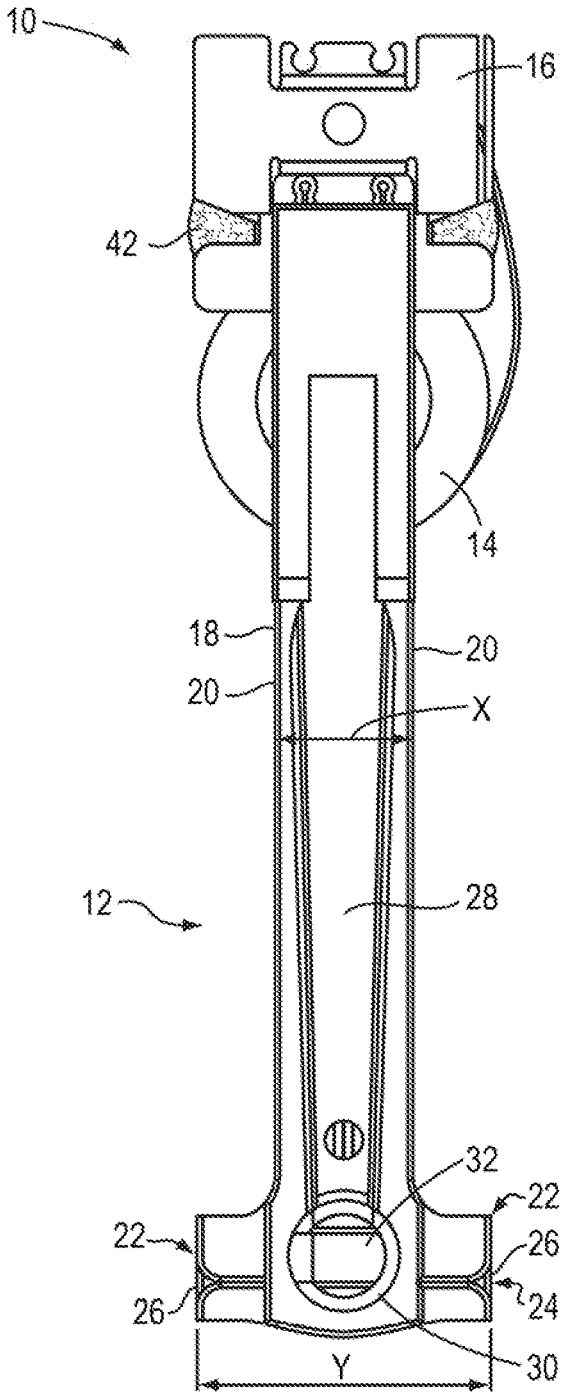
FIG. 1 is a front schematic view of an inverted constant force window balance system in accordance with one embodiment of the present invention.

FIG. 1 is a front view of one embodiment of a window balance system 10 in accordance with the present invention. Elements of the window balance include a shoe body 12, a coil spring 14, and a mounting bracket 16. The shoe body 12 may incorporate a generally T-shaped configuration that is similar in certain aspects to a balance shoe described in U.S. Pat. No. 6,679,000, the disclosure of which is hereby incorporated by reference herein in its entirety. The T-shaped shoe configuration may utilize an elongate portion 18 having two side walls 20 defining an elongate portion width X therebetween. Two opposing projections 22 may extend beyond the side walls 20 of the elongate portion form the enlarged portion 24 at a distal end of the shoe body 12. The projections 22 may each include a projection side wall 26 that define an enlarged portion width Y therebetween.

The shoe body 12 may define a longitudinal groove 28 that is designed to receive and permit passage of a pivot bar from a window sash. Existing inverted constant force balances often require that the sash frame or jamb be spread apart in order to load the sash into the shoes on either side of the frame. This may make the sash insertion more difficult during manufacture as well as in the field. With the depicted balance, however, the shoe may have a grooved lead-in that allows "drop in" of the pivot bar during sash installation. This may facilitate faster installation and removal of the sash in both a production environment and in the field. The groove may be open at the bottom proximate a cam 30 that is located within the enlarged portion 24 of the shoe 12. The cam 30 may include a keyhole 32 for receipt of the pivot bar, when the keyhole opening 32 is rotationally aligned with the groove 28. During installation of the sash, the pivot bar may slide from the groove 28 directly into the keyhole opening 32 in the cam 30. The coil spring 14 may be carried in a carrier section near an upper portion of the elongate portion 18 of the shoe body 12. The carrier section is shown in more detail in the following figures. A free end of the coil spring 14 may be secured to a mounting bracket 16 secured to a window jamb channel with a screw or other element, or the free end may be secured directly to the jamb channel.

Figure 2:
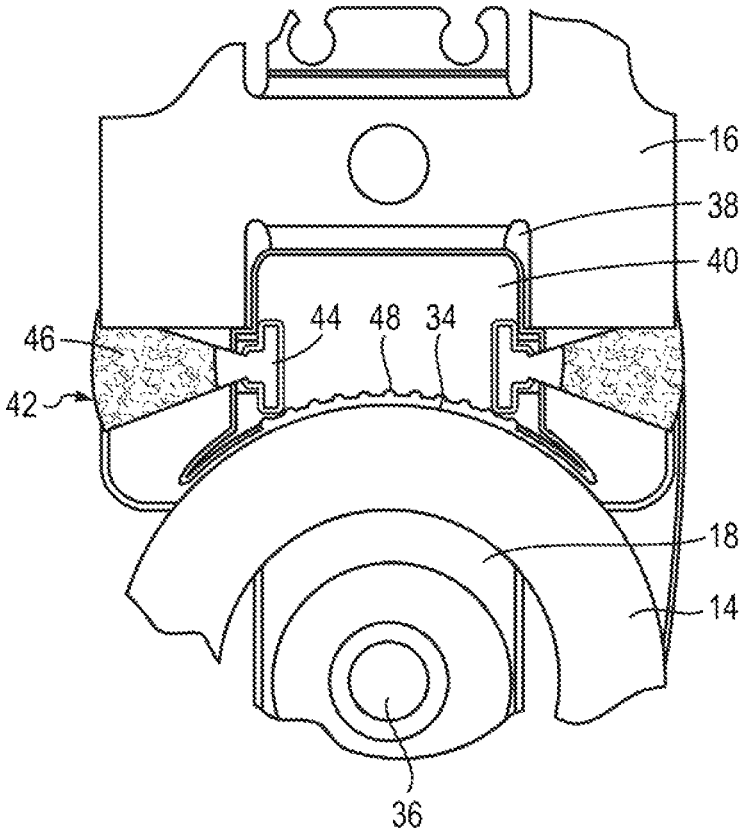
FIG. 2 is an enlarged partial rear schematic view of the inverted constant force window balance system of FIG. 1.

FIG. 2 depicts an enlarged partial rear view of a proximal end of the inverted constant force window balance 10 of FIG. 1. The elongate portion 18 may include a carrier section defined at least partially by curved upper 34 and lower surfaces that reduce friction as the coil spring 14 rotates therein. A central spindle 36 may be utilized to provide stand-off of the shoe 12 from a rear wall of the window jamb channel. Alternatively, the spindle 36 may be used as a mount for a spool hub for certain types of coil springs. The mounting bracket 16 may at least partially define a receiver 38 configured to accommodate a mating projection 40 at the top of the elongate portion 18. This configuration may prevent the mounting bracket 16 from becoming dislocated prior to installation. The mating projection 40 may be configured to receive one or more wiper systems 42 (generally, one on each side of the shoe 12). One typical wiper system 42 may include a supporting spline 44 with a tufted fabric pile 46 projecting therefrom, beyond the side wall 20 of the elongate portion 18. Dirt and debris (e.g., gypsum dust, sawdust, sand, etc.) are common in new construction atmospheres and can render coil springs inoperable or compromised. The wiper system 42 may wipe the coil clean during each sash opening and closing cycle and may be installed on either side of the elongate portion 18, depending on the location of the coil. Use of the wiper system 42 may also help reduce air infiltration that occurs as outside air moves vertically through the window jamb channel. The balance shoe 12 may also incorporate one or more debris traps 48 that provide a location for dust and debris to collect, without settling on the top of the coil.

Figure 3A:
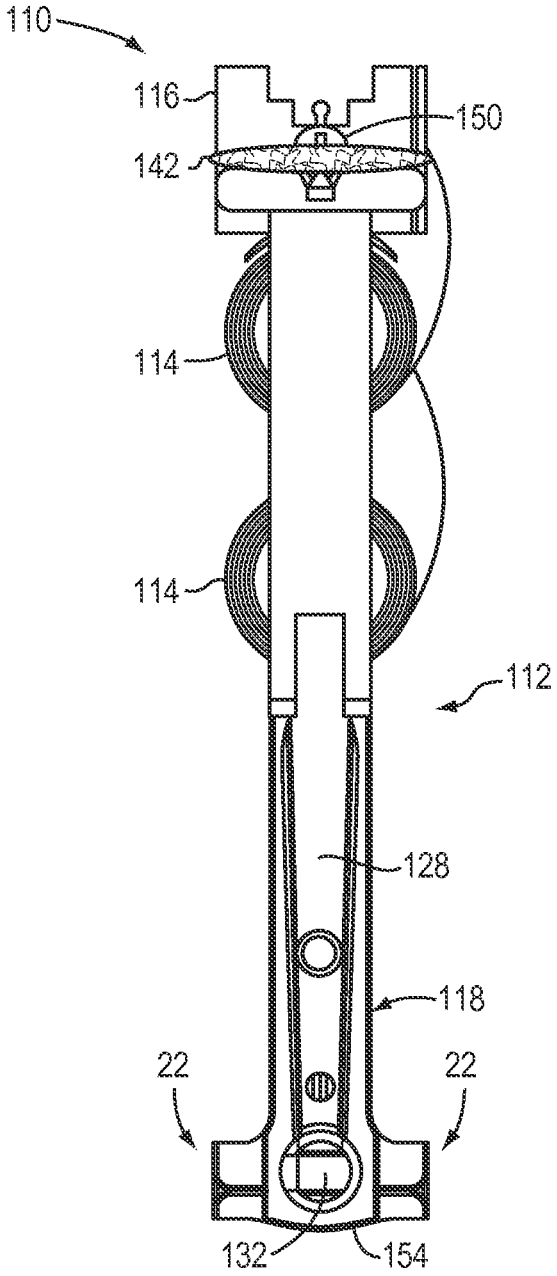
FIGS. 3A-3D are front, side, rear, and perspective schematic views of an inverted constant force window balance system in accordance with another embodiment of the invention.
Figure 3B:
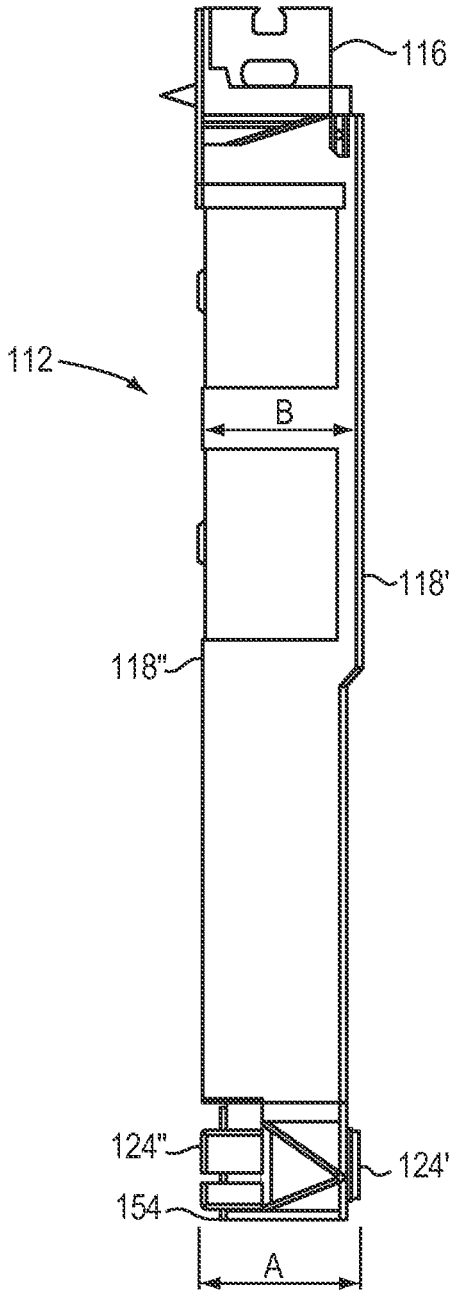
Figure 3C:
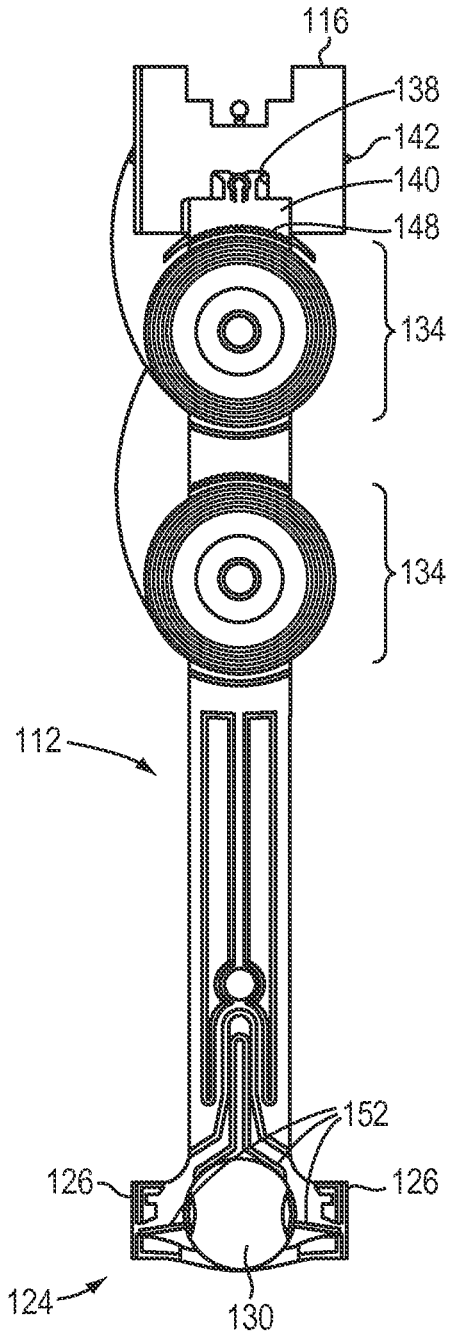

FIGS. 3A-3D are front, side, rear, and perspective schematic views of another embodiment of an inverted constant force window balance 110. The depicted window balance shoe includes two carrier sections 134 and a corresponding number of coil springs 114. Any number of carrier sections 134 and corresponding (or fewer) coil springs 114 may be utilized depending on the intended application of the window balance 110. In this embodiment, the wiper system 142 is a flexible rubber element that is secured to the top of the elongate portion 118. Alternatively, a foam element or a plastic element may be utilized to wipe the coil. The free end of the coil spring 114 may be secured to the window jamb channel with a mounting bracket, a spring clip, screw, or other element 150. Alternatively, the free end of the coil spring 114 may be formed into a hook or tab that may be inserted into an opening formed in the window jamb channel. As depicted in FIG. 3A, this embodiment also includes a groove 128 and a corresponding cam keyhole opening 132. As depicted in FIG. 3C, this embodiment also includes a receiver 138, a mating projection 140, and a debris trap 148.

A locking element 152 in communication with the cam 130 is depicted in FIG. 3C. This locking element may be a thin piece of metal or plastic with ends configured to retract within or project beyond the side walls 126 of the enlarged portion 124, so as to engage the window jamb channel upon rotation of the cam 130. In other embodiments, a locking plate may be forced by rotation of the cam 130 into a rear wall of the jamb channel to lock the shoe in place. Other elements of the window balance are described in conjunction with FIGS. 1 and 2.

Both the enlarged 124 and elongate 118 portions may include front 124', 118', and rear surfaces 124", 118", respectively, and the distances therebetween define the depths of those portions (A for the depth of the enlarged portion, B for the depth of the elongate portion), as seen in FIG. 3B. The dimensions of the elongate and enlarged portions of the shoe body may facilitate insertion of the shoe body into a window jamb channel. Window jamb channels may include a rear wall, two side walls, and two front flanges projecting from the side walls parallel to the rear wall, leaving a space for vertical travel of the pivot bar with the sash. The configuration of the shoe 112 of the present invention allows the shoe 112 to be inserted into the jamb channel without deforming the flanges. In prior art window balances, such as those described in the Background, to replace the balance, a large cutout or extensive deflection and/or heating of the jamb channel may be required. The cutout typically allows the shoe to be removed; whereas, heating the jamb channel softens the flanges such that they can be deformed to remove the shoe. The depicted balance, however, may only require a small notch located at some point in the jamb, typically at the top of the window, hidden behind a sash stop. The top of the elongate portion 118 (i.e., the top curved surface 131 of the carrier section with the wipers) can exit through this small notch and the balance shoe body 112 may be removed in accordance with the method described in FIGS. 10A-13B of U.S. Pat. No. 6,679,000 by a series of rotational steps. The coils may remain in the jamb channel, mounted to the mounting bracket 116, or may be removed individually through the small notch.

The depth A of the enlarged portion 124 may be such that the enlarged portion 124 may be inserted bottom surface 154 first into a window jamb channel, such that the bottom surface 154 is proximate a rear wall of the jamb channel. In this regard, the enlarged portion depth A may be substantially similar to, but smaller than, the gap between the two flanges. Thereafter, the shoe 112 may be rotated such that the rear surface of the shoe 112 is pointed upward. In order to rotate the shoe 112 to this position, the height of the enlarged portion may be slightly less than the depth of the jamb channel from the rear wall to the front flanges. The top end of the elongate portion 118 may be rotated (with the enlarged portion 124 acting essentially as a pivot) such that the shoe 112 is in the final vertical configuration. The springs 114 in the jamb channel may be aligned within the carrier sections during the rotation to vertical and the sash pivot pin may be inserted via the groove described above.

Figure 3D:
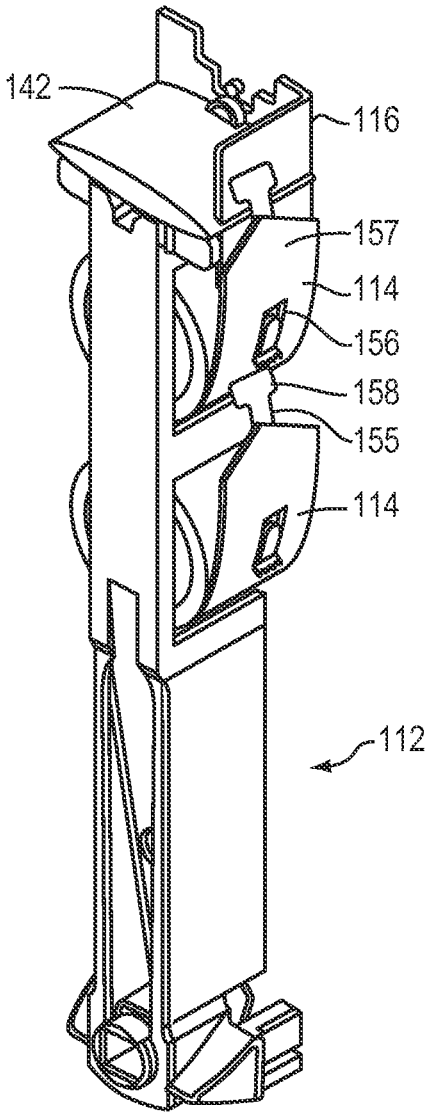

In the depicted embodiment in FIG. 3D, the coil springs 114 are configured such that a tab 158 located at a free end 155 of the lower coil may be inserted into an opening 156 defined by the free end 157 of the upper coil. This configuration may allow multiple coils to be connected together in parallel engagement in embodiments of the balance shoe 112 utilizing more than a single coil. Alternatively, the free ends 155, 157 of each coil may be directly connected to the mounting bracket, 116 other securing element, or to the jamb channel wall.

Figure 4A:
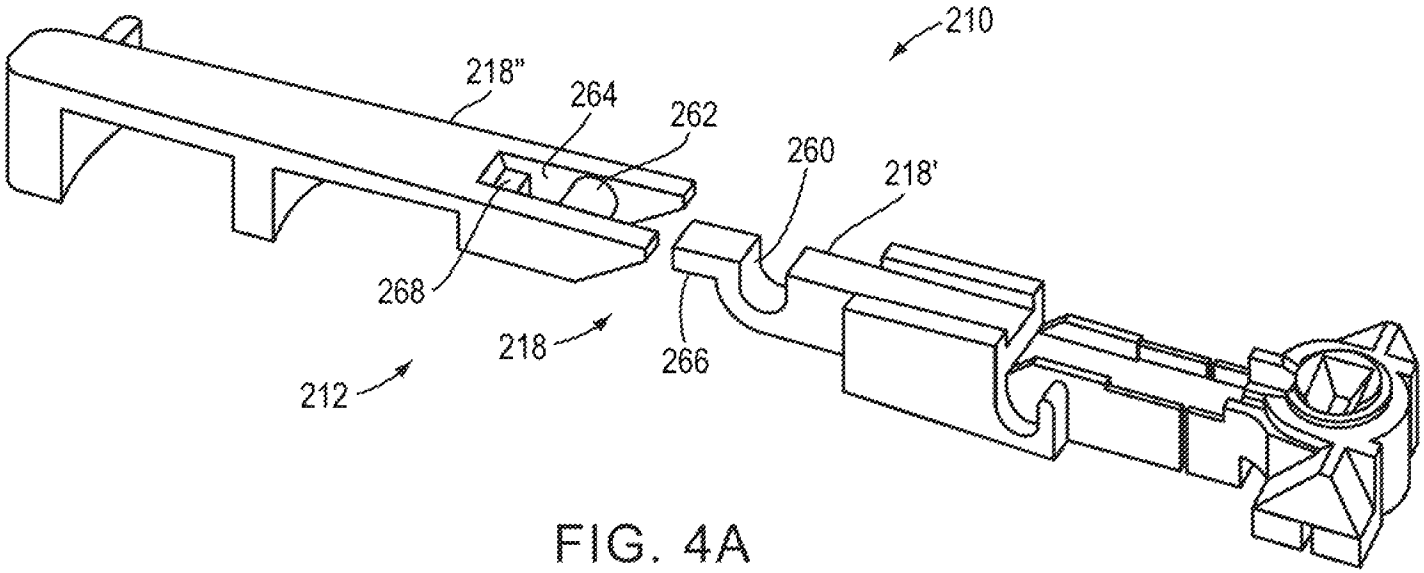
FIGS. 4A-4D are perspective schematic views of an inverted constant force window balance system in accordance with another embodiment of the invention.
Figure 4B:
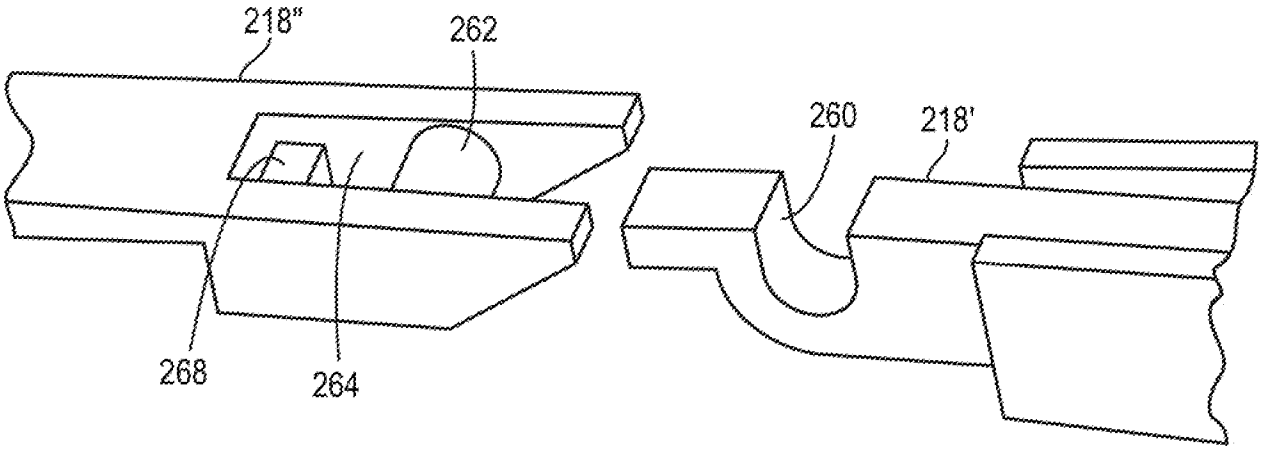
Figure 4C:
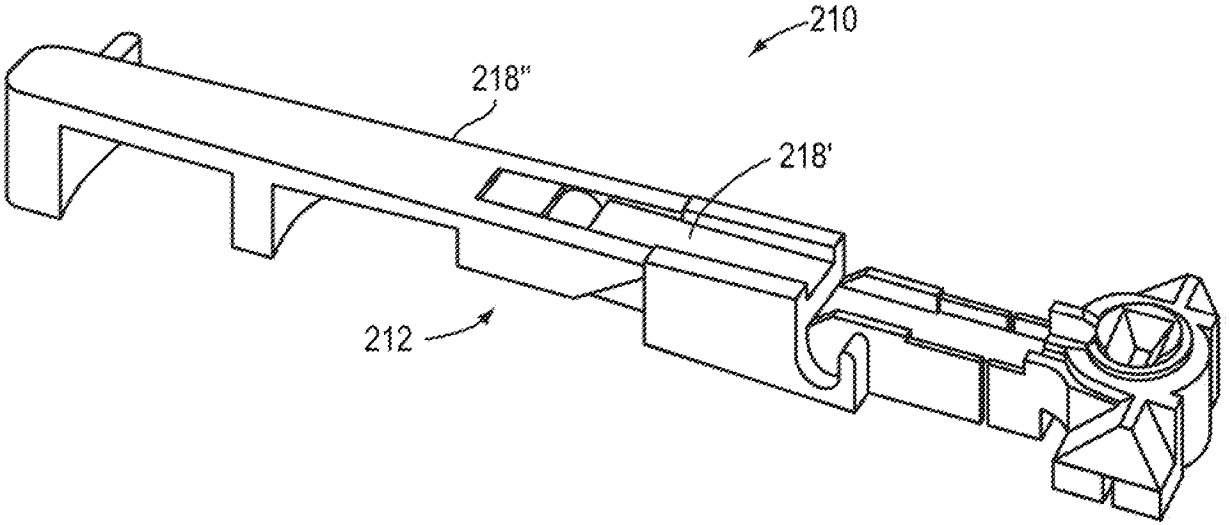
Figure 4D:
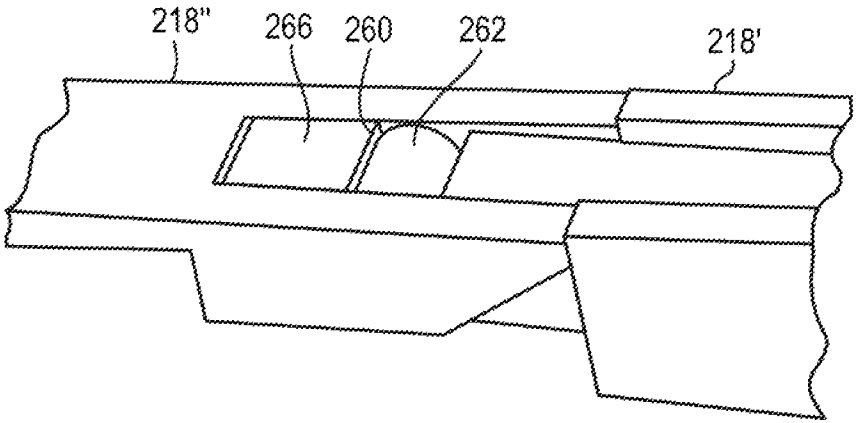

It should be noted that the shoe body of the balance system described herein may be manufactured of unitary construction (e.g., by injection molding) or may be more than one component, if desired. FIGS. 4A-4D depict such an embodiment 210. In this embodiment 210, the elongate portion 218 includes two elements 218', 218". These elements 218', 218" may be joined with a releasable connection that may include a hook 260 on the lower element 218' and a bar or pin 262 on the upper element 218", as depicted in FIGS. 4A and 4B. To connect the two elements 218', 218", the hook 260 may be inserted through an opening 264 formed in the upper element 218", then engaged with the bar 262, forming a secure connection. An optional extension 266 of the hook 260 may be received in a mating recess 268 in the upper element 218" to prevent over-rotation. The two elements 218', 218" are depicted in a connected configuration in FIGS. 4C and 4D. This two-piece configuration may ease insertion of the device 210 into a window jamb channel. The lower element 218' may be installed in accordance with the method described above. The upper element 218" may be installed in a similar manner, that is, the top end of the upper element 218" may be inserted sideways between the jamb channel flanges and rotated to a position such that the front surface faces upward. The upper 218" and lower 218' elements may then be connected and rotated into the final operating position simultaneously.

Other two-piece configurations are also contemplated. For example, the elongate portion may be discrete from the enlarged portion. In that case, the two portions may be connected by a spring hanger or other element that provides a tight fit therebetween. It is still desirable, though, that the enlarged portion of such a shoe body be configured to fit between the flanges of a window jamb channel.

Figure 5A:
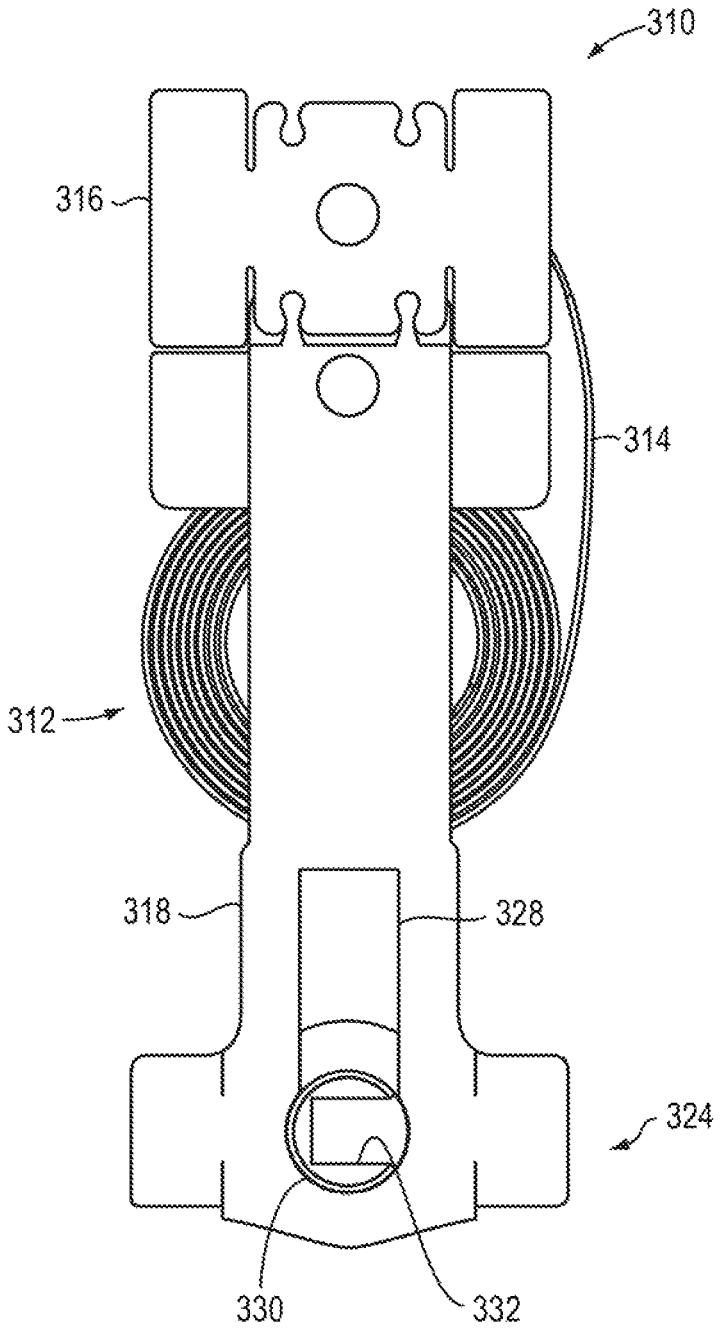
FIGS. 5A-5B are front and rear schematic views of a racking embodiment of an inverted constant force window balance system in accordance with another embodiment of the invention.
Figure 5B:
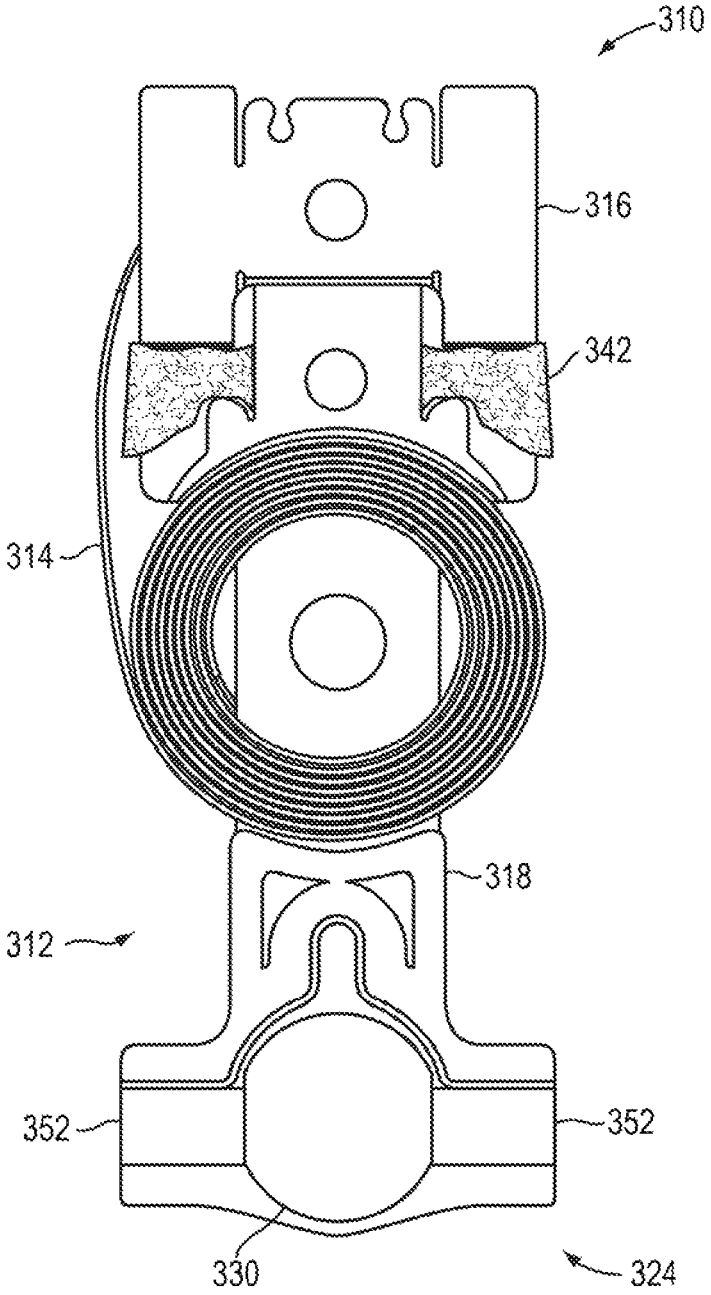

Another embodiment of an inverted constant force window balance 310 according to the invention may include a shoe body 312 for use in an improved racking embodiment, as depicted in FIGS. 5A and 5B. The shoe body 312 may be shorter in many aspects than the previously described embodiments 12, 112, and 212, such as a shorter elongate portion 318 and a shorter groove 328. The more compact design may allow for easier handling and servicing of the shoe 312, especially when in the field, as well as greater sash travel in the window frame. This permits a greater opening of the window, permitting greater access for entry or egress in an emergency situation. The balance 310 may also include a coil spring 314, a mounting bracket 316, an enlarged portion 324, a cam 330 with a keyhole 332, and a wiper system 342, amongst other features described above. Because of the size of the groove 328, the shoe 312 may need to be vertically offset from a corresponding shoe on the other side of a window sash during installation in the jamb or removal. The cam 330 may be in communication with a locking element 352, such that when the keyhole 332 is aligned with the groove 328, the locking element 352 engages the window jamb to hold the shoe 312 in place. To permit removal of the sash, the locking element 352 is sufficient to offset the recoil force associated with the coil spring 314, but not so strong, as to resist forced sliding in the jamb channel by the installer a sufficient distance to permit the pivot bar to disengage from one shoe 312. When the pivot bar is reinstalled in the keyhole 332, the shoe 312 is forced into horizontal alignment with the other shoe 312. The sash is then rotated so that the sash aligns with the window, and the cam 330 rotates and disengages the locking element 352 from the window jamb. This allows each shoe 312 to move freely within the jamb channel to counterbalance the sash.

The depicted balance shoe may be formed of any type of polymer suitable for a particular application. Injection molded plastics are particularly desirable to reduce costs of fabrication. Polyurethane, polypropylene, PVC, PVDC, EVA, and others are contemplated for use. Metal could also be used, if desired, for particular heavy sashes. The locking element may be metal or plastic and may be made from stainless steel, to prevent failure associated with use. Other configurations and materials are contemplated. Additionally, the window balance disclosed herein may be utilized in both tilt-in and fixed (i.e., not tilt-in) applications.

While there have been described herein what are to be considered exemplary and preferred embodiments of the present invention, other modifications of the invention will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the invention. Accordingly, what is desired to be secured by Letters Patent is the invention as defined and differentiated in the following claims, and all equivalents.

What is claimed is:

1. An inverted constant force window balance system comprising:

a shoe body comprising:

an elongate portion comprising at least one carrier section comprising at least one curved surface for supporting rotation of a constant force coil spring thereon;

a first enlarged portion at a proximal end of the elongate portion, the first enlarged portion comprising a locking element and a cam in communication with the locking element; and a second enlarged portion at a distal end of the elongate portion, the second enlarged portion comprising means for wiping a constant force coil spring surface, wherein the first and second enlarged portions each comprise a width greater than a width of the elongate portion;

a constant force coil spring supported in the carrier section; and means for securing the coil spring to a window jamb channel.

2. The window balance of claim 1, wherein the coil spring comprises a plurality of coil springs and the at least one carrier section comprises a plurality of carrier sections.

3. The window balance of claim 2, wherein a first coil spring defines an opening and wherein a second coil spring defines a tab, wherein the opening is configured to receive the tab.

4. The window balance of claim 1, wherein the securing means comprises at least one of a spring clip, a mounting bracket, a hook, a screw, and combinations thereof.

5. The window balance of claim 4, wherein the securing means comprises a mounting bracket comprising a receiver and wherein the shoe body comprises a projection adapted to mate with the receiver when the shoe body is proximate the mounting bracket.

6. The window balance of claim 1, further comprising a debris trap located above the at least one carrier section.

7. The window balance of claim 1, wherein the elongate member defines a groove for allowing passage of a pivot bar of a window sash.

8. The window balance of claim 7, wherein the cam defines a keyhole opening for receiving the pivot bar.

9. The window balance of claim 8, wherein the groove is aligned with the keyhole opening of the cam.

10. The window balance of claim 1, wherein the elongate portion comprises two side walls defining the elongate portion width therebetween.

11. The window balance of claim 10, wherein the first enlarged portion comprises a first projection and a second projection, and wherein each of the first projection and the second projection comprise a side wall defining therebetween the first enlarged portion width.

12. The window balance of claim 1, wherein the shoe body comprises a unitary component.

13. The window balance of claim 1, wherein the first enlarged portion is secured to the elongate portion with a connector.

14. The window balance of claim 13, wherein the connector comprises a hanger.

* * * * *